US011484083B1

(12) United States Patent
Hawkins

(10) Patent No.: US 11,484,083 B1
(45) Date of Patent: Nov. 1, 2022

(54) FORCE ABSORBING HELMET

(71) Applicant: Michael W. Hawkins, Wilmington, OH (US)

(72) Inventor: Michael W. Hawkins, Wilmington, OH (US)

( * ) Notice: Subject to any disclaimer, the term of this patent is extended or adjusted under 35 U.S.C. 154(b) by 164 days.

(21) Appl. No.: 16/895,414

(22) Filed: Jun. 8, 2020

Related U.S. Application Data

(60) Provisional application No. 62/857,895, filed on Jun. 6, 2019.

(51) Int. Cl.
*A42B 3/06* (2006.01)

(52) U.S. Cl.
CPC ..... *A42B 3/062* (2013.01)

(58) Field of Classification Search
CPC ..... A63B 71/10; A42B 3/0486; A42B 3/06; A42B 3/062; A42B 3/063; A42B 3/32; A42B 3/322
See application file for complete search history.

(56) References Cited

U.S. PATENT DOCUMENTS

| | | | | |
|---|---|---|---|---|
| 4,012,794 | A | 3/1977 | Nomiyama | |
| 5,204,998 | A | 4/1993 | Liu | |
| 9,179,727 | B2 | 11/2015 | Grant et al. | |
| 9,403,080 | B2 | 8/2016 | Jean et al. | |
| 9,642,410 | B2 | 5/2017 | Grice | |
| 9,763,487 | B1 | 9/2017 | Brown, Jr. | |
| 9,795,178 | B2 * | 10/2017 | Suddaby | A42B 3/121 |
| 9,820,522 | B2 | 11/2017 | Prabhu et al. | |
| 9,918,507 | B2 | 3/2018 | Eaton | |
| 9,987,544 | B2 | 6/2018 | Sodec, Jr. | |
| 10,010,126 | B1 | 7/2018 | Shaffer et al. | |
| 2015/0208751 | A1 * | 7/2015 | Day | A42B 3/064 2/414 |
| 2016/0029730 | A1 * | 2/2016 | Day | F16F 3/0873 2/412 |
| 2017/0112220 | A1 * | 4/2017 | Suddaby | A42B 3/0453 |
| 2018/0228239 | A1 * | 8/2018 | Day | A42B 3/064 |
| 2021/0169168 | A1 * | 6/2021 | Thorpe | A63B 71/10 |

* cited by examiner

*Primary Examiner* — Katherine M Moran
(74) *Attorney, Agent, or Firm* — Cramer Patent & Design, PLLC; Aaron R. Cramer

(57) ABSTRACT

A force absorbing helmet has an exterior shell and an interior shell, the interior shell further has an interior lumen comprising a viscous liquid and a plurality of hard springs. A plurality of micro-hinges are located on the exterior surface of the exterior shell to deflect the portions of the exterior shell due to a blunt force exerted thereon.

14 Claims, 5 Drawing Sheets

FORCE ABSORBING HELMET

RELATED APPLICATIONS

The present invention was first described in and claims the benefit of U.S. Provisional Patent Application No. 62/857,895 filed on Jun. 6, 2019, the entire disclosures of which are incorporated herein by reference.

FIELD OF THE INVENTION

The present invention relates generally to a helmet and more specifically to a force absorbing helmet.

BACKGROUND OF THE INVENTION

There a great many sports which require the use of helmets such as football, baseball, bicycle riding, hockey, motor sports, and the like. All of these helmets differ in their overall appearance and function but share the common goal of protecting the user's head from impact. Different areas of coverage, padding, internal suspension, and even the materials used all share the common goal of providing impact protection.

These same protective properties are also important in helmets used in fire, construction, military, and law enforcement activities as well. Manufacturers and researchers are constantly on the lookout for new materials and methods to enhance the safety properties of their protective helmets. Accordingly, there exists a need for a means by which the protective properties of helmets can be enhanced to further their injury preventing characteristics. The development of the impact protecting helmet with enhanced features fulfills this need.

SUMMARY OF THE INVENTION

To achieve the above and other objectives, the present invention provides for an impact protecting helmet which comprises a facemask, a plurality of strap attachment points, a plurality of neck supports and an outer shell having a plurality of micro hinges. The micro hinges are disposed on both sides of a front area, a crown area, and a rear area of the outer shell. The impact protecting helmet also comprises an inner shell which is disposed on the interior of the outer shell, a plurality of micro springs each of which are attached to the inner surface of the outer shell at a first end of each of the micro-springs and to the outer surface of the inner shell at a second end of each of the micro-springs to provide additional shock absorbing capability. The impact protecting helmet also comprises an interstitial space disposed between the outer shell and the inner shell filled with a viscous material, an interior layer of low-resilience polyurethane foam which allows for comfort cushioning against the head of a person to provide an additional layer of impact protection and a hinge pin which is positioned between a pair of hinge plates. The hinge pin allows for motion along a rotational movement path for deflection between adjacent sections of the outer shell and transfer of energy to other portions of the impact protecting helmet.

The micro hinges may be linear in nature and are intended to deform under impact to absorb shock. The micro hinges may be mirror images to each other. The micro hinges may be positioned to allow the outer shell to absorb impact by deflection of alignment of the outer surface of the outer shell. The inner shell may be provided with a plurality of standard air bags that may provide overall support and provide positioning of the impact protecting helmet on the head of the person. The inner shell may provide a stable mounting surface for the standard air bags and the low-resilience polyurethane foam on a first side of the inner shell and the micro springs on the other side of the inner shell. The outer shell and the inner shell may form the interstitial space to contain the viscous material which surrounds the micro springs. The inner shell may be ½ inch thick. The micro hinges may be physically affixed to the section of the outer shell with a fastening means. The fastening means may be a fastener selected from the group consisting of a plurality of rivets, an adhesive, or a plurality of screws. The interstitial space may be leakproof. The low-resilience polyurethane foam may be a continuous covering on the interior of the impact protecting helmet. The standard air bags may be disposed immediately underneath the interior layer of low-resilience polyurethane foam.

An energy wave amplitude from external contact may be diminished by flexing the outer shell, compression of the micro springs, displacement of the viscous material, dispersion along the inner shell, compression of the standard air bags, and compression and dispersion of the low-resilience polyurethane foam before contact of the person's head. The impact protecting helmet may provide physical impact protection for the head of the person. The impact protecting helmet may reduce injuries resulting from impact, shock, vibration, and resultant internal damage from a spinal injury, a neck injury, a skull injury, or a concussion. The impact protecting helmet may be worn while playing a sport selected from the group consisting of football, baseball, bicycle riding, hockey, or motor sport. The impact protecting helmet may be worn during an activity selected from the group consisting of a fire-fighting activity, a construction activity, a military activity, and a law enforcement activity.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
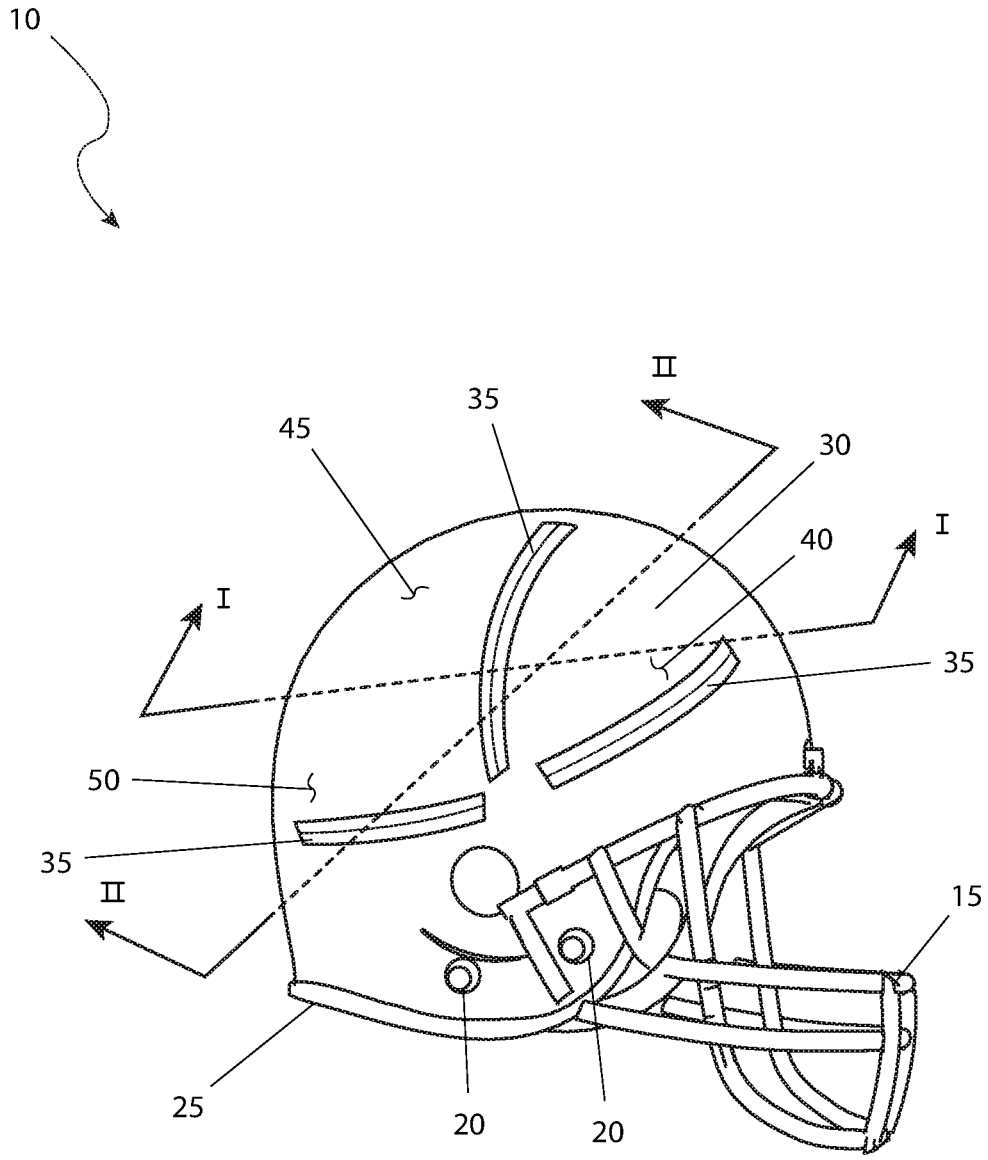
FIG. 1 is a perspective right-hand view of the impact protecting helmet, according to the preferred embodiment of the present invention.

10 impact protecting helmet
15 facemask
20 strap attachment point
25 neck support
30 outer shell
35 micro hinge
40 front area

45 crown area
50 rear area
55 inner shell
60 micro spring
65 viscous material
70 standard air bag
75 low-resilience polyurethane foam
80 gap
85 fastening means
90 hinge pin
95 hinge plate
100 rotational movement path "a"
105 impact energy wave
110 energy wave amplitude

1. Description of the Invention

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

2. Detailed Description of the Figures

Referring now to FIG. 1, a perspective right-side view of the impact protecting helmet 10, according to the preferred embodiment of the present invention is disclosed. The impact protecting helmet 10 (herein also described as the "helmet") 10, provides physical impact protection for the head of a user. The helmet 10 is intended to reduce injuries resulting from crushing impacts, shock, vibration and resultant internal damage including but not limited to spinal injuries, neck injuries, skull injuries, and concussions. The helmet 10 as portrayed in FIG. 1 as well as the remaining disclosure is that of one (1) typically worn during the game of football. However, other types of helmets such as those worn in the sport of baseball, bicycle riding, hockey, motor sports, and the like as well as helmet 10 used in fire-fighting, construction, military, and law enforcement activities as well can benefit from the teachings of the present invention. As such, the various descriptions relating specifically to a football helmet are for illustrative purposes only. The use of the teachings of the present invention on any type of protective helmet 10 for the head is not intended to be a limiting factor of the present invention.

The helmet 10 is provided with standard appointments such as a facemask 15, strap attachment points 20, and neck supports 25 as would typically be expected. The outer shell 30 is provided with a total of six (6) micro hinges 35 of which only three (3) are visible due to illustrative limitations. These micro hinges 35 are provided on the front area 40, the crown area 45, and the rear area 50 of the outer shell 30 and would be repeated on both sides. The micro hinges 35 are linear in nature and are intended to deform under impact to absorb shock. Further detail on the operation and configuration of the micro hinges 35 will be provided herein below.

Figure 2:
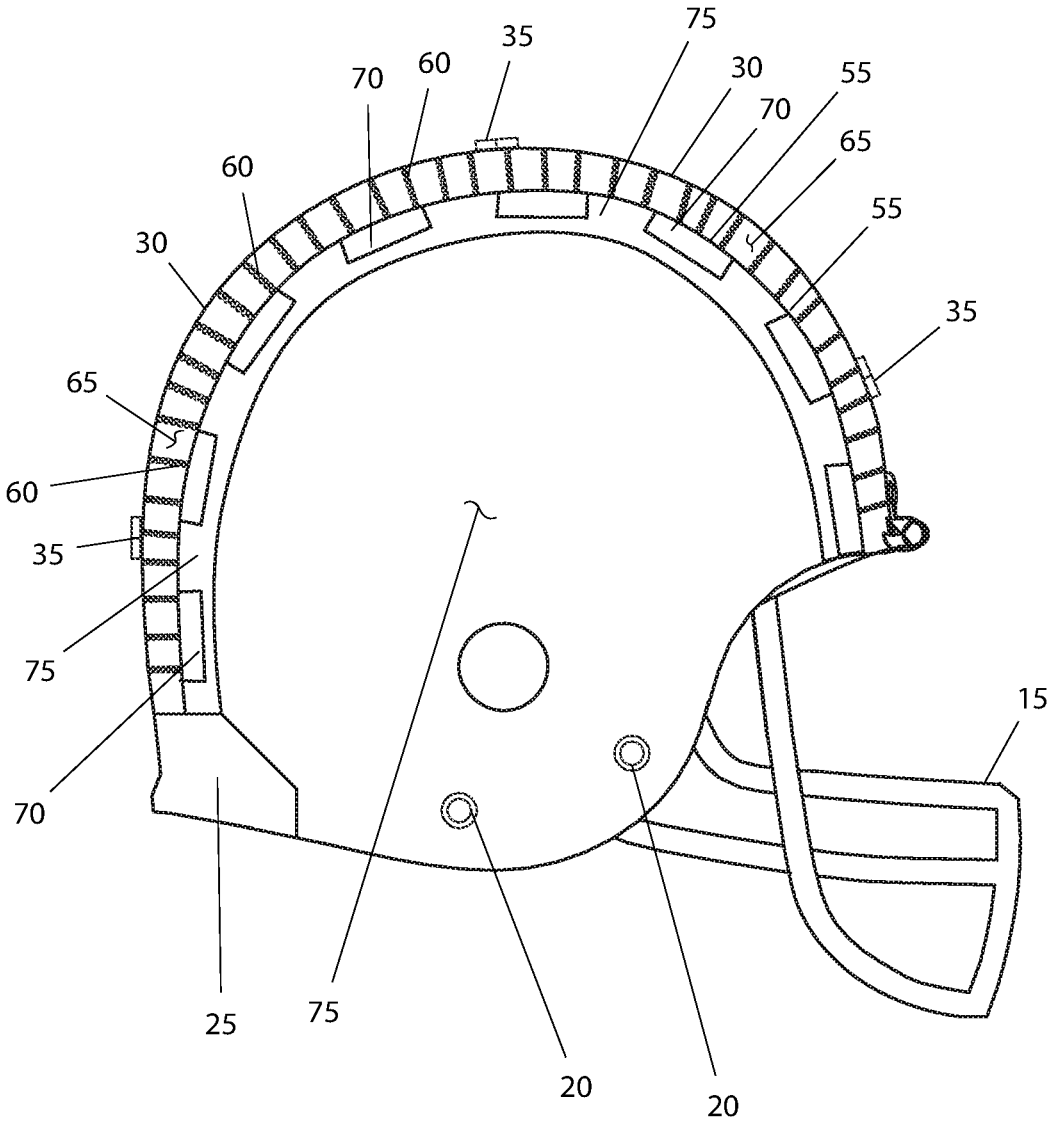
FIG. 2 is a sectional view of the impact protecting helmet, as seen along a line I-I, as shown in FIG. 1, according to the preferred embodiment of the present invention.

Referring next to FIG. 2, a sectional view of the helmet 10, as seen along a line I-I, as shown in FIG. 1, according to the preferred embodiment of the present invention is depicted. The facemask 15, strap attachment points 20 and neck supports 25, remain visible or partly visible in this figure. A section of three (3) of the six (6) micro hinges 35 are visible on the outer surface of the outer shell 30. This positioning allows the outer shell 30 to absorb impact by deflection of alignment of the outer surface of the outer shell 30. An inner shell 55 is visible along an offset dimension of approximately one-half inch (½ in.) on the interior of the outer shell 30. A plurality of micro springs 60, which are attached to the inner surface of the outer shell 30 at one of their ends and to the outer surface of the inner shell 55 at the opposing end provided additional shock absorbing properties. Further detail on the micro springs 60 will be provided herein below.

The balance of the interstitial space between the outer shell 30 and the inner shell 55 is filled with a viscous material 65. As such, any deformation of the outer shell 30 will result in forces being applied to the local micro springs 60 as well as the viscous material 65. These forces would then be diminished and dissipated through the entire helmet 10 and result in a lower overall point impact on the interior of the helmet 10. The inner shell 55 is provided with conventionally available standard air bags 70 that form the overall support and provide positioning of the helmet 10 on the head of the user. An interior layer of low-resilience polyurethane foam 75 (memory foam) is provided to allow for comfort cushioning against the head of the user as well as provide a final layer of impact protection. The low-resilience polyurethane foam 75 is visible as a continuous covering on the balance of the interior of the helmet 10.

Figure 3:
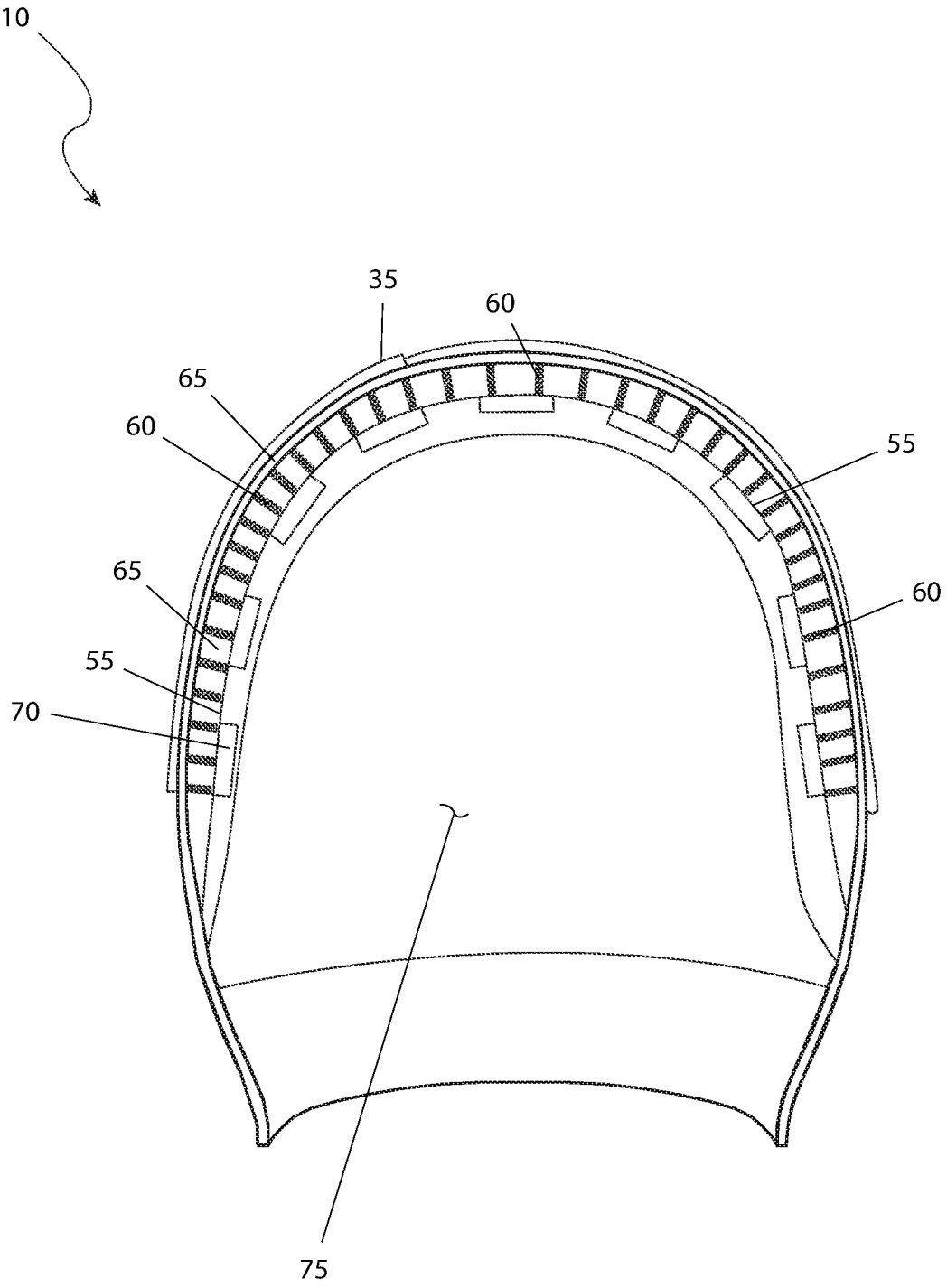
FIG. 3 is a sectional view of the impact protecting helmet, as seen along a line II-II, as shown in FIG. 1, according to the preferred embodiment of the present invention.

Referring now to FIG. 3, a sectional view of the helmet 10, as seen along a line II-II, as shown in FIG. 1, according to the preferred embodiment of the present invention is shown. This view is similar to that of FIG. 2 due to the symmetrical nature of a helmet 10 and the physical protection afforded about the entire perimeter. The low-resilience polyurethane foam 75 is visible as an innermost layer with periodic spacings of the standard air bags 70 immediately underneath. The inner shell 55 provides a stable mounting surface for the standard air bags 70 and the low-resilience polyurethane foam 75 on one (1) side and the micro springs 60 on the other. The outer shell 30 and the inner shell 55 also form a leakproof interstitial space to contain the viscous material 65 which surrounds the micro springs 60 as well. Two (2) of the six (6) micro hinges 35 are visible. The sectional cut as shown discloses the micro hinges 35 near the crown area 45 of the helmet 10. The neck support(s) 25 is visible across the lower back edge of the helmet 10.

Figure 4:
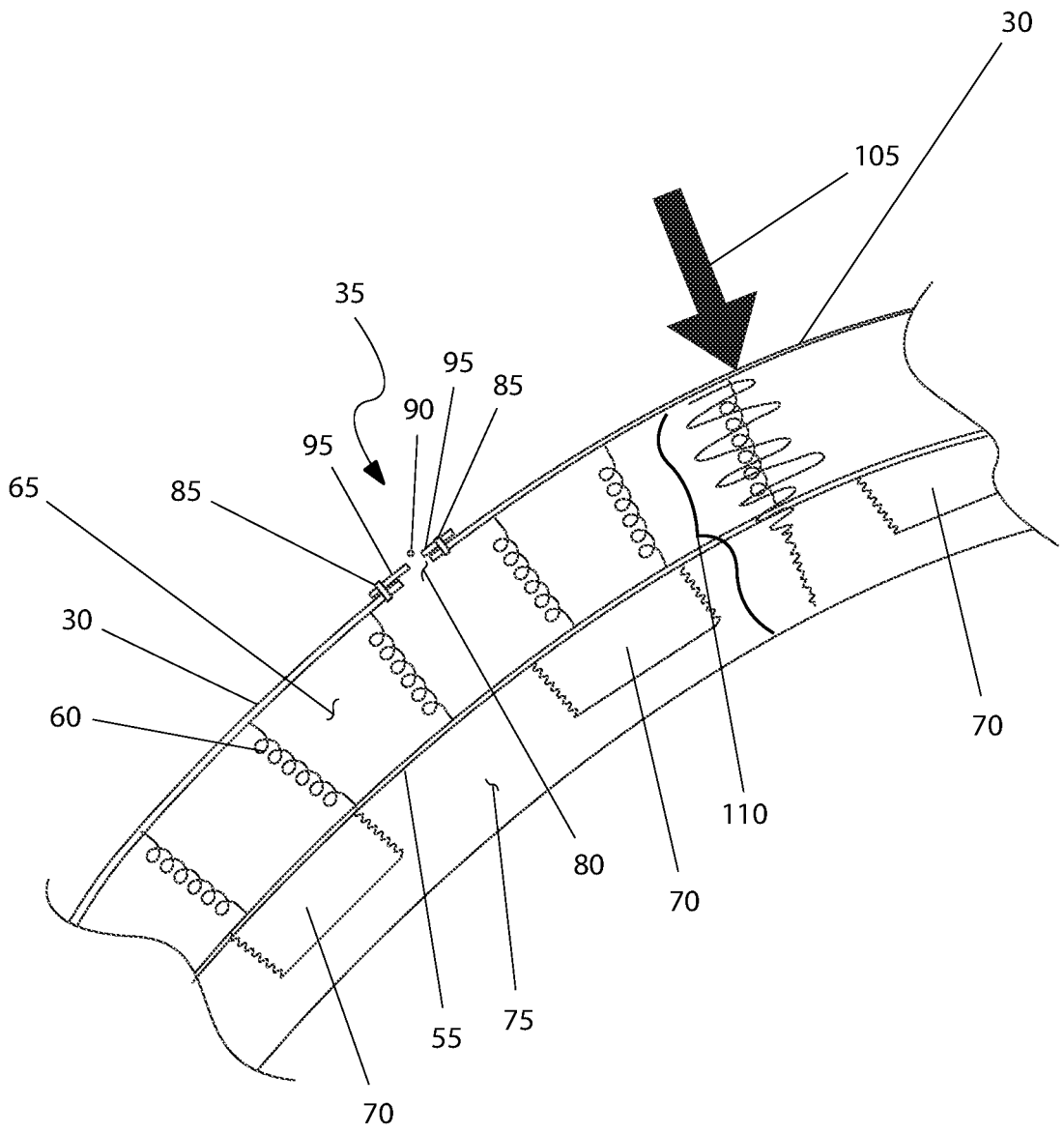
FIG. 4 is a detailed view of the micro hinges as part of the impact protecting helmet 10, according to the preferred embodiment of the present invention; and, FIG. 5 is a perspective left-hand view of the impact protecting helmet, according to the preferred embodiment of the present invention

Referring to FIG. 4, a detailed view of the micro hinges 35 as part of the helmet 10, according to the preferred embodiment of the present invention is disclosed. The micro hinges 35 are physically affixed to the section of the outer shell 30 between a fastening means 85 such as rivets, adhesive, screws or the like. A hinge pin 90 between two (2) hinge plates 95 allow for motion along a rotational movement path "a" 100. This rotational movement path "a" 100 allows for deflection between adjacent sections of the outer shell 30 and thus allows for easy transfer of energy to remaining components of the helmet 10. As the impact energy wave 105 continues inward, the energy wave amplitude 110 is diminished by the flexing of the outer shell 30, the compression of the micro springs 60, the displacement of the viscous material 65, the dispersion along the inner shell 55, the compression of the standard air bags 70, and the compression and dispersion of the low-resilience polyurethane foam 75 before contact of the user's head (not shown).

Figure 5:
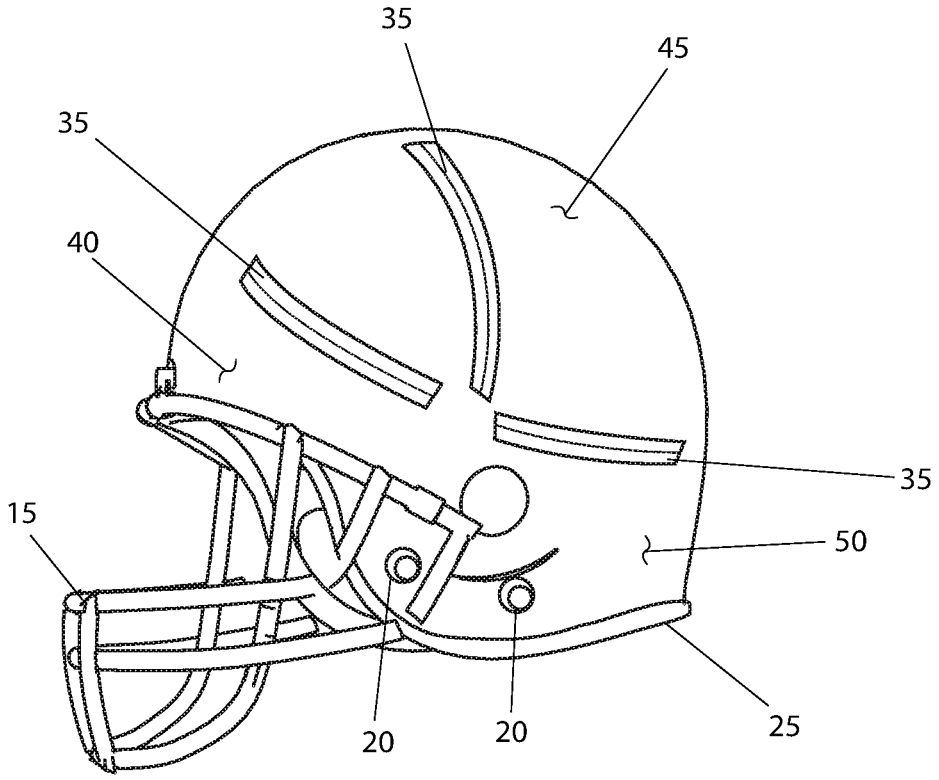
Figure 5:
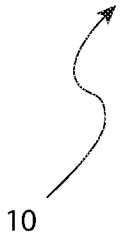

Referring to FIG. 5, a perspective left-hand view of the impact protecting helmet 10, according to the preferred embodiment of the present invention is depicted. As aforementioned described, the helmet 10 is provided with the facemask 15, strap attachment points 20, and neck supports 25 as would typically be expected. Three (3) of the six (6) micro hinges 35 are depicted on the outer shell 30. The micro hinges 35 are provided on the front area 40, the crown area 45, and the rear area 50 of the outer shell 30 and are a mirror image of the three (3) shown in FIG. 1, and would be repeated on both sides. The micro hinges 35 are linear in nature and are intended to deform under impact to absorb shock as aforementioned described.

3. Operation of the Preferred Embodiment

The preferred embodiment of the present invention can be utilized by the common user in a simple and effortless manner with little or no training. It is envisioned that the helmet 10 would be constructed in general accordance with FIG. 1 through FIG. 5. The user would procure the helmet 10 from conventional sources such as sporting goods stores, sporting good distributors, personal protective equipment (PPE) distributors, law enforcement supply houses, military equipment manufacturers, and the like. Particular attention would be paid to type of helmet 10, intended usage, size, color, and the like.

During utilization of the helmet 10, the following procedure would be initiated: the helmet 10 would be placed atop the user's head in a customary manner; any securing methods such as chin straps would be utilized. The helmet 10 is then worn/utilized in a manner identical to that of current protective helmets helmet 10 thus not requiring any new knowledge or education of the user. Should an impact energy wave 105 be delivered to the outer shell 30, the outer shell 30 flexes inward providing the first step of protection; the second step is provided by the micro hinges 35 allowing a greater level of deformation of the outer shell 30, the third step of protection is provided by the micro springs 60 compressing and absorbing the impact; the fourth step is provided by the viscous material 65 which further dissipates the impact energy wave 105; the fifth step of protection is provided by the inner shell 55; the sixth step of protection is provided by the standard air bags 70; and the final and seventh step of protection is the low-resilience polyurethane foam 75. These seven (7) layers/levels of protection diminish the energy wave amplitude 110 thus reducing/eliminating potential physical injury to the user.

After use of the helmet 10, it is removed and stored until needed again. Should a large impact damage or permanently deform the helmet 10, it should be removed from service and be repaired or replaced as necessary.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. An impact protecting helmet, comprising:
- a facemask;
- a plurality of strap attachment points;
- a plurality of neck supports;
- an outer shell having a plurality of micro hinges, the micro hinges are disposed on both sides of a front area, a crown area, and a rear area of the outer shell;
- an inner shell disposed interiorly to the outer shell;
- a plurality of micro-springs each attached to an inner surface of the outer shell at a first end of each of the micro-springs and to an outer surface of the inner shell at a second end of each of the micro-springs to provide additional shock absorbing capability;
- an interstitial space disposed between the outer shell and the inner shell and filled with a viscous material;
- an interior layer of low-resilience polyurethane foam configured to provide comfort cushioning against the head of a person to provide an additional layer of impact protection; and
- a hinge pin allowing for motion along a rotational movement path for deflection between adjacent sections of the outer shell and transfer of energy to other portions of the impact protecting helmet;
- wherein the inner shell having a plurality of air bags mounted thereon and the air bags are configured to provide overall support and positioning of the impact protecting helmet on the head of a person.

2. The impact protecting helmet, according to claim 1, wherein the micro hinges are linear and are intended to deform under impact to absorb shock.

3. The impact protecting helmet, according to claim 1, wherein the micro hinges are mirror images to each other.

4. The impact protecting helmet, according to claim 1, wherein the micro hinges are positioned and configured to allow the outer shell to absorb impact by deflection of alignment of an outer surface of the outer shell.

5. The impact protecting helmet, according to claim 1, wherein the air bags and low-resilience polyurethane foam are mounted to an inner surface of the inner shell such that the inner shell is configured to provide a stable mounting surface for the air bags and the low-resilience polyurethane foam and the outer surface of the inner shell is configured to provide a stable mounting surface for the micro-springs.

6. The impact protecting helmet, according to claim 1, wherein the viscous material surrounds the micro-springs.

7. The impact protecting helmet, according to claim 1, wherein the inner shell is ½ inch thick.

8. The impact protecting helmet, according to claim 1, wherein the micro hinges are physically affixed to both sides of the front area, crown area, and rear area of the outer shell with a fastening means.

9. The impact protecting helmet, according to claim 8, wherein the fastening means is a fastener selected from the group consisting of a plurality of rivets, an adhesive, or a plurality of screws.

10. The impact protecting helmet, according to claim 1, wherein the interstitial space is leakproof.

11. The impact protecting helmet, according to claim 1, wherein the impact protecting helmet is configured to provide physical impact protection for the head of the person.

12. The impact protecting helmet, according to claim 1, wherein the impact protecting helmet is configured to provide reduction in injuries resulting from impact, shock, vibration, and resultant internal damage from a spinal injury, a neck injury, a skull injury, or a concussion.

13. The impact protecting helmet, according to claim 1, wherein the impact protecting helmet is configured to be worn while playing a sport selected from the group consisting of football, baseball, bicycle riding, hockey, or motor sport.

14. The impact protecting helmet, according to claim 1, wherein the impact protecting helmet is configured to be worn during an activity selected from the group consisting of a fire-fighting activity, a construction activity, a military activity, and a law enforcement activity.

* * * * *